US008997428B2

(12) United States Patent
Souchek et al.

(10) Patent No.: US 8,997,428 B2
(45) Date of Patent: Apr. 7, 2015

(54) TENSION LINK FOR DRILL FLOOR SUBSTRUCTURE ASSEMBLY

(71) Applicants: Richard D. Souchek, Richmond, TX (US); Keith J. Orgeron, Spring, TX (US)

(72) Inventors: Richard D. Souchek, Richmond, TX (US); Keith J. Orgeron, Spring, TX (US)

(73) Assignee: T&T Enigneering Services, Inc., Tomball, TX (US)

( * ) Notice: Subject to any disclaimer, the term of this patent is extended or adjusted under 35 U.S.C. 154(b) by 0 days.

(21) Appl. No.: 13/875,053

(22) Filed: May 1, 2013

(65) Prior Publication Data

US 2013/0291462 A1 Nov. 7, 2013

Related U.S. Application Data

(60) Provisional application No. 61/641,224, filed on May 1, 2012.

(51) Int. Cl.
*E04B 5/02* (2006.01)
*E21B 15/00* (2006.01)

(52) U.S. Cl.
CPC ..... *E21B 15/00* (2013.01)

(58) Field of Classification Search
CPC ..... E04F 15/00; E04F 15/02; E02D 27/44; E04H 12/16; E04C 3/10; E04C 5/08; E04B 5/00; E04B 5/02; E04B 5/023; E04B 2001/3583; E04B 1/343
USPC ..... 52/79.1, 79.5, 79.6, 177, 223.1, 582.1, 52/582.2, 584.1; 292/194, 195, 200, 202, 292/DIG. 11, DIG. 31, DIG. 63; 166/79.1
See application file for complete search history.

(56) References Cited

U.S. PATENT DOCUMENTS

| | | | | |
|---|---|---|---|---|
| 5,641,239 | A | 6/1997 | Michalek | |
| 7,958,688 | B2 * | 6/2011 | Vilar Llop et al. | 52/582.2 |
| 2004/0211598 | A1 | 10/2004 | Palidis | |
| 2008/0072515 | A1 * | 3/2008 | Huhnerbein | 52/582.2 |

FOREIGN PATENT DOCUMENTS

| | | | |
|---|---|---|---|
| JP | 2008-093253 | A | 4/2008 |
| JP | 2010-180949 | A | 8/2010 |

* cited by examiner

*Primary Examiner* — Charles A Fox
*Assistant Examiner* — Patrick Maestri
(74) *Attorney, Agent, or Firm* — John G. Fischer, Esq.; Jaspal S. Hare, Esq.; Scheef & Stone, L.L.P.

(57) ABSTRACT

The present invention relates to a new tension link drill floor level connection system for use on a drilling rig, as may be used in subterranean exploration. The present invention provides a tension link assembly for resisting separating forces incurred between sections of the substructure. In particular, the tension link assembly may be located at the drill floor level for resisting the separating forces imparted by "splayed" or wide leg mast structures that tend to separate substructure side boxes from the substructure center section. The present invention may be comprised of a first link element and a second link element with a tension link being connectable over the first and second link elements to resist separation between sections of the substructure. A latch mechanism may be utilized to prevent upward movement of the tension side boxes or center section relative to the drill floor or to one another.

4 Claims, 4 Drawing Sheets

TENSION LINK FOR DRILL FLOOR SUBSTRUCTURE ASSEMBLY

TECHNICAL FIELD OF INVENTION

The present invention relates to a new tension link drill floor level connection system for use on a drilling rig, as may be used in subterranean exploration. The present invention provides a tension link for resisting separating forces incurred between sections of the substructure. In particular, the invention provides a mechanism at the drill floor level that resists the separating forces imparted by "splayed" or wide leg mast structures that tend to separate substructure side boxes from the substructure center section. In an alternative embodiment of the invention, a latch mechanism is also provided to prevent vertical movement of sections of the substructure.

BACKGROUND OF THE INVENTION

In the exploration of oil, gas and geothermal energy, drilling operations are used to create boreholes, or wells, in the earth. Drilling rigs used in subterranean exploration must be transported to the locations where drilling activity is to be commenced. These locations are often remotely located. The transportation of such rigs on state highways requires compliance with highway safety laws and clearance underneath bridges or inside tunnels. This requirement results in extensive disassembly of full-size drilling rigs to maintain a maximum transportable width and transportable height with further restrictions on maximum weight, number and spacing of axles, and overall load length and turning radius. These transportation constraints vary from state to state, as well as with terrain limitations. These constraints can limit the size and capacity of rigs that can be transported and used, conflicting with the subterranean requirements to drill deeper, or longer, and reach horizontal wells more quickly, requiring larger rigs.

Larger, higher capacity drilling rigs are needed for deeper (or horizontally longer) drilling operations, since the hook load for deeper operations is very high, requiring rigs to have a capacity of 500,000 lbs. and higher. Constructing longer, deeper wells requires increased torque, mud pump capacity and the use of larger diameter tubulars in longer strings. Larger equipment is required to handle these larger tubulars and longer strings. All of these considerations drive the demand for larger rigs.

Modern high capacity drilling rigs are transported in sections and reassembled at the desired location. Typical assemblies include a pair of top and bottom side boxes on either side of a center section to form the complete substructure. The mast is typically transported in three sections; the lower mast section, the center mast section, and the upper section. The top of the substructure forms the drill floor. The mast is assembled and raised above the drill floor. Then the substructure is raised, lifting the raised mast. The top sections of the substructure are connected to the center section at a location beneath the drill floor.

Larger rigs require a wider base structure for strength and wind stability, and this requirement conflicts with the transportability constraint and the time and cost of moving them. The wide leg base and large loads of the higher capacity drilling rigs impart higher outward forces at the drilling floor level where they are connected. The connection of the legs to the substructure is made at the top side boxes. The outward forces urge the side boxes away from the center section connected between them, pivoting at the connections beneath the drill floor level.

It remains desirable to prevent the separation that occurs between the top side boxes and the center sections on high capacity drilling rigs. It is desirable to accomplish this task affordably. It is also desirable to accomplish this task without significant modification to existing, conventional designs for drilling rigs. It is also desirable to accomplish this task without adding significant time to the rig-up and rig-down procedures. It is also desirable to accomplish this task without adding machine or crane work to the solution. It is also desirable to accomplish this task without having to engage manpower beneath the substructure.

In summary, the preferred embodiments of the present invention provide unique solutions to many of the problems arising from a series of overlapping design constraints, including design limitations, rig-up and rig-down, and cost constraints.

SUMMARY OF THE INVENTION

The present invention relates to a new tension link drill floor connection system for use on a drilling rig, as may be used in subterranean exploration. The present invention provides a tension link assembly for resisting separating forces incurred between sections of the substructure. In particular, the invention provides a mechanism at the drill floor level that resists the separating forces imparted by "splayed" or wide leg mast structures that tend to separate substructure side boxes from the substructure center section.

In one embodiment, a drilling rig is provided, comprising a collapsible substructure including a side top box and a center section connectable to the side top box. A drill floor is formed on the top side of the side top box and the top side of the center section. A first link element is formed on the side top box, near to the drill floor. A second link element is formed on the center section adjacent to the first link element. A tension link is connectable to the first and second link elements, such that forces urging separation of the first and second link elements are resisted by the tension link.

In another embodiment, the tension link is connectable to the first link element and second link element from the drill floor. In another embodiment, the first link element, second link element, and tension link are located substantially at the drill floor level of the drilling rig.

In another embodiment, the first link element is a lug connected to the side top box. The second link element is a lug connected to the center section. The tension link is connectable over the first and second link elements, such that forces urging separation of the first and second link elements are resisted by the tension link.

In another embodiment, the first link element is a relief in the side top box, and the second link element is a relief in the center section. The tension link is insertable into the first and second link elements, such that forces urging separation of the first and second link elements are resisted by the tension link.

In another embodiment, a latch mechanism is provided for preventing upward movement of the side top box and center section in relation to each other as well as the drill floor.

In another embodiment, a method of preventing separation of the drill floor of a drilling rig is provided. In this embodiment, the steps include providing a first link element on the side top box, providing a second link element on a center section at a location that is substantially adjacent to the first link element, and providing a tension link connectable to the first and second link elements to prevent separation of the first and second link elements. In this method, a latch mechanism may be provided adjacent the tension link for preventing upward movement of the side top box and the center section in relation to the drill floor as well as to one another.

As will be understood by one of ordinary skill in the art, the sequence of the steps disclosed may be modified and the same advantageous result obtained.

BRIEF DESCRIPTION OF THE DRAWINGS

The objects and features of the invention will become more readily understood from the following detailed description and appended claims when read in conjunction with the accompanying drawings in which like numerals represent like elements.

The drawings constitute a part of this specification and include exemplary embodiments to the invention, which may be embodied in various forms. It is to be understood that in some instances various aspects of the invention may be shown exaggerated or enlarged to facilitate an understanding of the invention.

DETAILED DESCRIPTION OF THE PREFERRED EMBODIMENTS

The following description is presented to enable any person skilled in the art to make and use the invention, and is provided in the context of a particular application and its requirements. Various modifications to the disclosed embodiments will be readily apparent to those skilled in the art, and the general principles defined herein may be applied to other embodiments and applications without departing from the spirit and scope of the present invention. Thus, the present invention is not intended to be limited to the embodiments shown, but is to be accorded the widest scope consistent with the principles and features disclosed herein.

Figure 1:
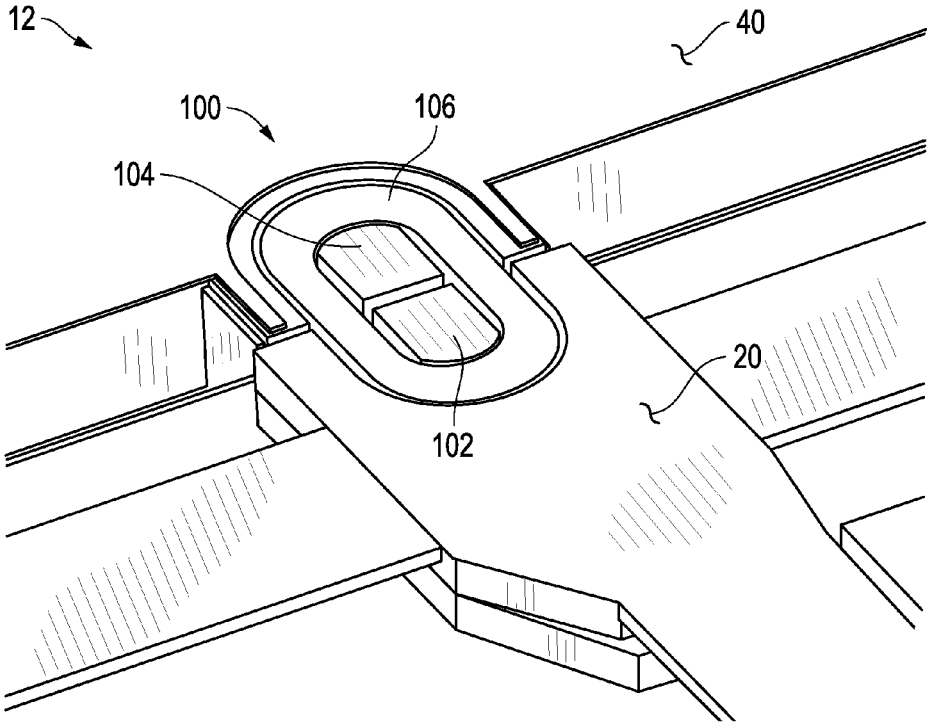
FIG. 1 is an isometric view of a drill floor level locking system having certain features in accordance with the present invention.

FIG. 1 is an isometric view of a drill floor level locking system having certain features in accordance with the present invention.

In this embodiment, a drilling rig 10 is provided (not shown), comprising a collapsible substructure 12 including a side top box 20, and a center section 40 connectable to side top box 20. A drill floor 30 (not shown) is formed on the top side of side top box 20 and the top side of center section 40. Tension link assembly 100 is shown connecting side top box 20 and center section 40.

A first link element 102 is formed on side top box 20, near to drill floor 30 (not shown). A second link element 104 is formed on center section 40 adjacent to first link element 102. A tension link 106 is connectable to first link element 102 and second link element 104, such that forces urging separation of first link element 102 and second link element 104 are resisted by tension link 106. In the embodiment shown, tension link 106 is generally ellipsoidal or elliptical in shape and has a central recess for connection of first link element 102 and second link element 104. First link element 102, second link element 104, and tension link 106 may be formed of a suitably rigid material, such as a hard metal. In particular, tension link 106 may be formed to be sufficiently strong to resist forces imparted on first link element 102 and second link element 104 by separation of side top box 20 and center section 40.

In another embodiment illustrated by FIG. 1, tension link 106 is connectable to first link element 102 and second link element 104 from drill floor 30, preventing the necessity of sending a worker beneath drill floor 30 to install tension link 106.

In another embodiment illustrated in FIG. 1, first link element 102, second link element 104, and tension link 106 are located substantially at the level of drill floor 30 of drilling rig 10.

In another embodiment illustrated in FIG. 1, first link element 102 is a lug formed on side top box 20. Second link element 104 is a lug formed on center section 40. Tension link 106 is connectable over first link element 102 and second link element 104, such that forces urging separation of first link element 102 and second link element 104 are resisted by tension link 106. In another embodiment, a method of preventing separation of drill floor 30 of drilling rig 10 is provided. In this embodiment, the steps include providing a first link element on the side top box, providing a second link element on a center section at a location that is substantially adjacent to the first link element, and providing a tension link connectable to the first and second link elements to prevent separation of the first and second link elements.

Figure 2:
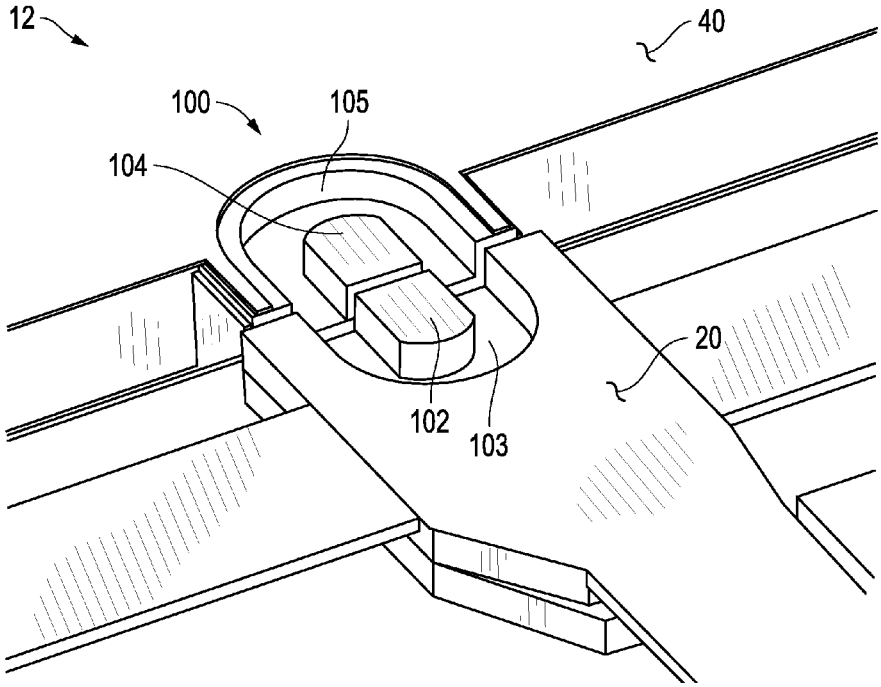
FIG. 2 is an isometric view of the drill floor level locking system with the tension link removed to further illustrate certain features of the present invention.

FIG. 2 illustrates tension link assembly 100 from FIG. 1 with tension link 106 removed for a better view of first link element 102 and second link element 104. More specifically, in the embodiment of tension link assembly 100 shown in the present figure, a first link element relief 103 and a second link element relief 105 are illustrated. First link element relief 103 is a relief in side top box 20. The relief may be, for example, semi-circular or triangular in shape. Second link element relief 105 is also a complementary relief in center section 40, and may generally have the same shape as first link element relief 103. Tension link 106 is insertable into first link element relief 103 and second link element relief 105, such that forces urging separation of first link element 102 and second link element 104 are resisted by tension link 106. By way of example, and not limitation, tension link 106 may be "bone shaped" so as to fit in opposing triangular shaped reliefs of first link element relief 103 and second link element relief 105 of this alternate embodiment.

Figure 3:
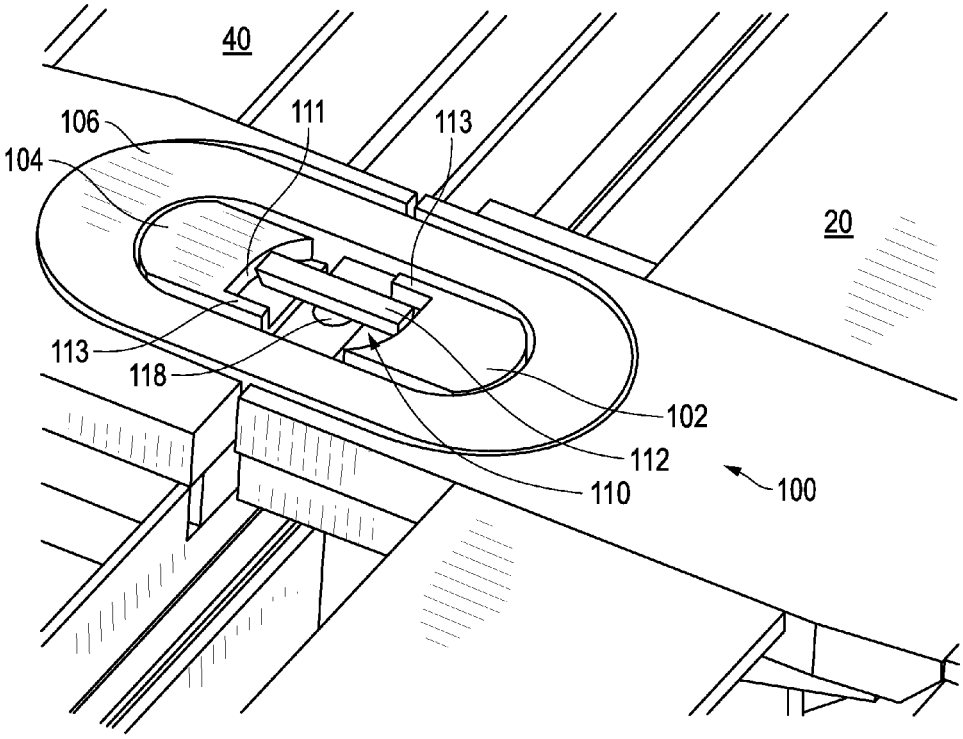
FIG. 3 is an isometric view of the drill floor level locking system having certain features in accordance with the present invention, including a latch mechanism for preventing upward movement of the side box and center section in relation to one another and the drill floor.
Figure 4:
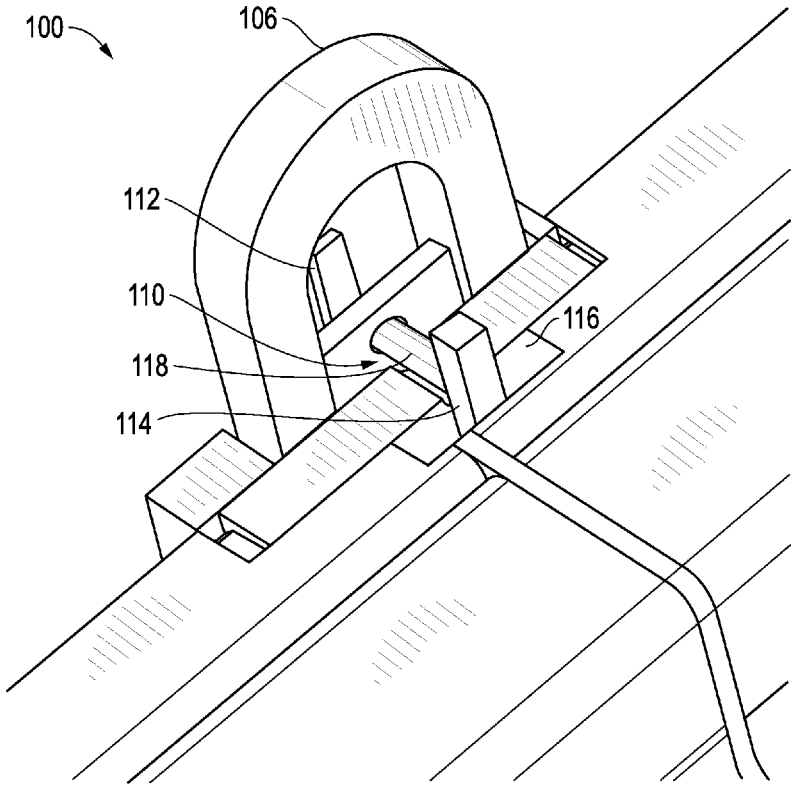
FIG. 4 is an isometric view of the drill floor system shown in FIG. 3 with the center section removed for clarity.

FIGS. 3 and 4 are isometric views of an alternative embodiment of tension link assembly 100 having certain features in accordance with the present invention, including a latch mechanism 110 for preventing upward movement and disengagement of side top box 20 and center section 40 in relation to one another as well as drill floor 30.

In FIG. 3, in the embodiment illustrated, latch mechanism 110 is provided for preventing upward or vertically separating movement of side top box 20 and center section 40 in relation to each other. This in turn helps to maintain the position of tension link 106 in relation to side top box 20 and center section 40 as well as drill floor 30. In a preferred embodiment shown, latch mechanism 110 is operable from above drill floor 30 so as not to necessitate sending a worker beneath drill floor 30 to secure tension link 106 in place.

As illustrated, and also referring to FIG. 4, latch mechanism 110 may have a handle 112 and a latch 114 (FIG. 4) connected by a connector 118. Twisting handle 112 causes connector 118 and attached latch 114 to rotate, thereby engaging a latch relief 116 (FIG. 4) to secure side top box 20 and center section 40 in vertical alignment with one another and to resist disengagement of tension link 106 from first and second link elements 102 and 104.

A handle relief 111 may be provided on both first link element 102 and second link element 104 within which handle 112 resides. A handle limiter 113 may extend from link element 102 or 104 to limit the amount of rotation by handle 112. Handle limiter 113 may simply be a portion on first link element 102 and/or second link element 104 which has been shaped to provide a stop to handle 112. Alternatively, handle limiter 113 may extend from tension link 106.

FIG. 4 illustrates the alternative embodiment of tension link assembly 100 with center section 40 removed for additional clarity. In this figure, latch 114, latch relief 116, and connector 118 may be more readily seen located below handle 112. Additionally, it can be seen that handle 112 is oriented to be substantially parallel with latch 114. That is, handle 112 and latch 114 may share the same vertical plane such that a well operator turning handle 112 may be certain through visual inspection that latch 114, hidden by first link element 102 and second link element 104, is properly oriented in either a locked or unlocked position. Turning handle 112 rotates connector 118 and latch 114 to facilitate the desired locking or unlocking operation.

In another embodiment of the invention, rather than having a handle limiter 113 to limit rotation of handle 112, latch relief 116 may instead be converted to limit the rotation of latch 114, and handle limiter 113 removed for free rotation of handle 112.

As will be understood by one of ordinary skill in the art, the sequence of the steps disclosed may be modified and the same advantageous result obtained. For example, the exact shape of first and second link elements 102 and 104 and engaging tension link 106 can vary significantly and still obtain the result of resisting separation.

Having thus described the present invention by reference to certain of its preferred embodiments, it is noted that the embodiments disclosed are illustrative rather than limiting in nature and that a wide range of variations, modifications, changes, and substitutions are contemplated in the foregoing disclosure and, in some instances, some features of the present invention may be employed without a corresponding use of the other features. Many such variations and modifications may be considered desirable by those skilled in the art based upon a review of the foregoing description of preferred embodiments. Accordingly, it is appropriate that the appended claims be construed broadly and in a manner consistent with the scope of the invention.

The invention claimed is:

1. A method of preventing separation of the drill floor of a drilling rig, comprising:

providing a first link element on the upper surface of a side top box;

providing a second link element on the upper surface of a center section at a location that is substantially adjacent to the first link element;

providing a substantially oval tension link connectable to the first and second link elements to prevent separation of the first and second link elements; and, providing a latch mechanism located adjacent the tension link for preventing upward movement of the side top box and the center section in relation to the drill floor as well as to one another, wherein the latch mechanism comprises:

a handle;

a latch; and, a connector connecting the handle and the latch, and being inserted between the first and second link elements.

2. A drilling rig, comprising:

a collapsible substructure including:

a side top box;

a center section connectable to the side top box; and, a drill floor formed on a top side of the side top box and a top side of the center section;

a first link element formed on the upper surface of the side top box;

a second link element formed on the upper surface of the center section;

the first link and second link elements being located in adjacent alignment when side top box and center section are positioned for connection to each other;

a substantially oval tension link connectable to the first and second link elements; and, a latch mechanism for preventing upward movement of the tension link assembly in relation to the drill floor, the latch mechanism comprising:

a handle;

a latch; and, a connector connecting the handle and the latch, and being insertable between the first and second link elements;

wherein forces urging separation of the first and second link elements are resisted by the tension link.

3. The drilling rig according to claim 2, the latch mechanism further comprising:

a handle relief, the handle residing in the handle relief; and, a latch relief, the latch residing in the latch relief.

4. The drilling rig according to claim 2, further comprising:

a handle limiter for limiting rotation of the handle.

* * * * *